US009334687B2

(12) United States Patent
Jang

(10) Patent No.: US 9,334,687 B2
(45) Date of Patent: May 10, 2016

(54) DUAL ROLL BLIND

(75) Inventor: Seong-Ryong Jang, Seoul (KR)

(73) Assignee: WINTEC KOREA INC., Gwangju-si (KR)

( * ) Notice: Subject to any disclaimer, the term of this patent is extended or adjusted under 35 U.S.C. 154(b) by 623 days.

(21) Appl. No.: 13/807,301

(22) PCT Filed: Jun. 14, 2011

(86) PCT No.: PCT/KR2011/004352

§ 371 (c)(1),
(2), (4) Date: Dec. 27, 2012

(87) PCT Pub. No.: WO2012/011666

PCT Pub. Date: Jan. 26, 2012

(65) Prior Publication Data

US 2013/0098564 A1 Apr. 25, 2013

(30) Foreign Application Priority Data

Jul. 20, 2010 (KR) ..... 10-2010-0070008

(51) Int. Cl.
*A47G 5/02* (2006.01)
*A47H 1/00* (2006.01)
(Continued)

(52) U.S. Cl.
CPC ... *E06B 9/40* (2013.01); *E06B 9/42* (2013.01); *E06B 9/50* (2013.01); *E06B 9/68* (2013.01);
(Continued)

(58) Field of Classification Search
CPC ..... E06B 2009/405; E06B 9/40; E06B 9/42; E06B 9/50; E06B 9/68; E06B 2009/2452; E06B 2009/2458; E06B 2009/2405
USPC ..... 160/120, 122, 126, 237, 263, 321, 241, 160/242
See application file for complete search history.

(56) References Cited

U.S. PATENT DOCUMENTS 2,581,433 A * 1/1952 North et al. ..... 160/120
2,702,081 A * 2/1955 North et al. ..... 160/120
(Continued)

FOREIGN PATENT DOCUMENTS

| | | | |
|---|---|---|---|
| JP | 56-149954 | A | 11/1981 |
| KR | 20-0398864 | Y1 | 10/2005 |
| KR | 20-0401004 | Y1 | 11/2005 |
| KR | 10-0770043 | B1 | 10/2007 |

*Primary Examiner* — Syed A Islam
*Assistant Examiner* — Jeremy Ramsey
(74) *Attorney, Agent, or Firm* — Novick, Kim & Lee, PLLC; Jae Youn Kim

(57) ABSTRACT

The present invention relates to a dual roll blind enabling to control its light transmission amount and open and close with one ball-chain. The dual roll blind comprises a first screen and a second screen having light transmission portions and light shielding portions, respectively, a first winding bar and a second winding bar for respectively winding the first screen and the second screen, a first axis of rotation and a second axis of rotation to which the first winding bar and the second winding bar are respectively coupled, a first gear coupled to the first axis of rotation and rotationally driving the first winding bar, a second gear coupled to the second axis of rotation and rotating the second winding bar with rotating dependently on the first gear, a driving wheel rotating by a driving string and coupled to the first axis of rotation to transfer rotational force of the driving string to the first gear and the winding bar, a slide drive device engaging with the driving wheel to receive rotational force of the driving wheel and slide the first winding bar in a longitudinal direction of the first axis of rotation.

6 Claims, 10 Drawing Sheets

(51) Int. Cl.

| | |
|---|---|
| ***E06B 9/40*** | (2006.01) |
| ***E06B 9/42*** | (2006.01) |
| ***E06B 9/68*** | (2006.01) |
| ***E06B 9/50*** | (2006.01) |
| *E06B 9/24* | (2006.01) |

(52) U.S. Cl.
CPC . *E06B 2009/2405* (2013.01); *E06B 2009/2452* (2013.01); *E06B 2009/2458* (2013.01); *E06B 2009/405* (2013.01)

(56) References Cited

U.S. PATENT DOCUMENTS

| | | | | |
|---|---|---|---|---|
| 8,025,088 | B2 * | 9/2011 | Kim | 160/120 |
| 8,550,142 | B2 * | 10/2013 | Gaskill et al. | 160/121.1 |
| 2009/0173454 | A1 * | 7/2009 | Cheng | 160/120 |
| 2009/0283224 | A1 | 11/2009 | Kim | |
| 2011/0061821 | A1 * | 3/2011 | Kim | 160/305 |
| 2013/0098563 | A1 * | 4/2013 | Jang | 160/120 |

* cited by examiner (a)

(b)

(c)

(a)

(b)

DUAL ROLL BLIND

TECHNICAL FIELD

The present invention relates to a dual roll blind, and more particularly, to a dual roll blind enabling users to control its light transmission amount and open and close with one ball-chain.

BACKGROUND ART

Generally, a roll blind is a device mounted on a transparent glass window or glass wall for blocking light from the outside to control interior atmosphere.

The conventional roll blind has a structure that one roll screen having the same light transmission amount in its whole area is wound around a bar for winding to block the light. Such a roll blind has a structure that a roll screen is wound up around a winding bar, and an upper portion of the roll screen is fixed to the bar such that controlling the height of the roll screen is only a way to control the light transmission amount.

According to the way controlling the light transmission amount by controlling the height of roll screen, the light completely penetrates a part (the lower portion) of the glass window or glass wall and is completely blocked in a part (the upper portion), so it is impossible to uniformly control the light transmission amount in the whole area of glass window or glass wall. Therefore, a structure capable to uniformly control the light transmission amount in the whole area is required.

To solve such a problem, a method for controlling the light transmission amount by disposing two sheets of roll screens comprising light transmitting portions and light shielding portions alternately disposed widthwise or lengthwise to be overlapped and controlling the overlapped amount was proposed in the past.

However, most of such devices place emphasis on the function for controlling the light transmission amount and such devices become complicated and shoddy. That is, since such devices have a function controlling the light transmission amount, however, those are too big or complicated, some problems that the practicality and durability deteriorate are encountered.

Especially, since an operating apparatus for controlling the overlapped amount of two roll screens is needed separately from a ball-chain for operating a winding bar to control the light transmission amount, the operation of roll blind becomes complicated and the device becomes complicated. Accordingly, the cost increases and the durability and the credibility of the device deteriorate and such products are avoided in the market.

Accordingly, a roll blind having a structure enabling ascent and descent of roll screen and control of the overlapped amount of two sheets of roll screens with one ball-chain, a simple mechanical structure, and a good credibility in spite of repeated operations is required.

A technical object of the present invention is to provide a dual roll blind enabling to control the light transmission amount of the roll screen and its open and close with one single ball-chain.

Technical objects of the present invention are not limited to above-mentioned ones and unmentioned other technical objects can clearly be understood by a person of ordinary skill in the pertinent art through the following description.

DISCLOSURE OF INVENTION

Technical Problem

A technical object to achieve of the present invention is to provide a dual roll blind enabling to control the light transmission amount of the roll screen and its open and close with one single ball-chain.

Technical objects of the present invention are not limited to above-mentioned ones and unmentioned other technical objects can clearly be understood by a person of ordinary skill in the pertinent art through the following description.

Solution to Problem

A dual roll blind according to an embodiment of the present invention to achieve the above technical object comprises a first screen and a second screen having light transmission portions and light shielding portions, respectively, a first winding bar and a second winding bar for respectively winding the first screen and the second screen, a first rotation shaft and a second rotation shaft to which the first winding bar and the second winding bar are respectively coupled, a first gear coupled to the first rotation shaft and rotationally driving the first winding bar, a second gear coupled to the second rotation shaft and rotating the second winding bar with rotating dependently on the first gear, a driving wheel rotating by a driving string and coupled to the first rotation shaft to transfer rotational force of the driving string to the first gear and the winding bar, a slide drive device engaging with the driving wheel to receive rotational force of the driving wheel and slide the first winding bar in a longitudinal direction of the first axis of rotation of the first rotation shaft.

The slide drive device can comprise a slide cylinder interposed between the first rotation shaft and the first winding bar and having a thread groove in a parallel direction to the first axis of rotation of the first rotation shaft on a side and a connecting driving shaft, disposed in parallel with the first axis of rotation of the first rotation shaft, to one end of which a driving gear engaging with the driving wheel is coupled and on the other end of which a screw portion coupled with the thread groove is formed.

The dual roll blind further comprises a plug interposed between the first rotation shaft and the slide cylinder and having a concave groove extended in a longitudinal direction from the outer circumference and the connecting driving shaft can rotatably be inserted into the concave groove.

The driving wheel further comprises an internal gear type of gear portion on the inner circumference and the driving gear is positioned inside the driving wheel and engages with the gear portion.

The dual roll blind can further comprise a clutch device interposed between the first rotation shaft and the driving wheel to selectively transfer rotational driving force of the driving wheel to the first winding bar.

The clutch device comprises a clutch hub interposed between the first rotation shaft and the driving wheel and having a spiral groove on the outer circumference and a clutch ring interposed between the clutch hub and the driving wheel and having an inner protrusion inserted into the spiral groove inside and at least one outer protrusion outside, and the driving wheel can comprise on the inner circumference at least one long groove formed in parallel with the first axis of rotation of the first rotation shaft and into which the outer protrusion is inserted.

Advantageous Effects of Invention

According to the present invention, the open and close and the light transmission amount of the roll screen can simultaneously be controlled by operating one single driving string. Especially, since the open and close structure and the light transmission amount controlling structure of roll screen are made in one simple and credible mechanical structure, the cost-reduction effect is excellent because of the simplification of the structure and the device has an excellent durability in spite of repeated operations.

Particularly, the clutch device interposed between the first rotation shaft and the driving wheel to selectively transfer driving force of the driving wheel to the first winding roll has a structure capable to control delay time that driving force is not transferred by coupling of the clutch ring and the clutch hub. Since such a structure enables easy control of the horizontal moving distance of the first screen, the same can be applied to various products only with change of clutch hub although the widths of the light shielding portions and the light transmitting portions of the first screen and the second screen are various.

DESCRIPTION FOR KEY ELEMENTS IN THE DRAWINGS

Figure 1:
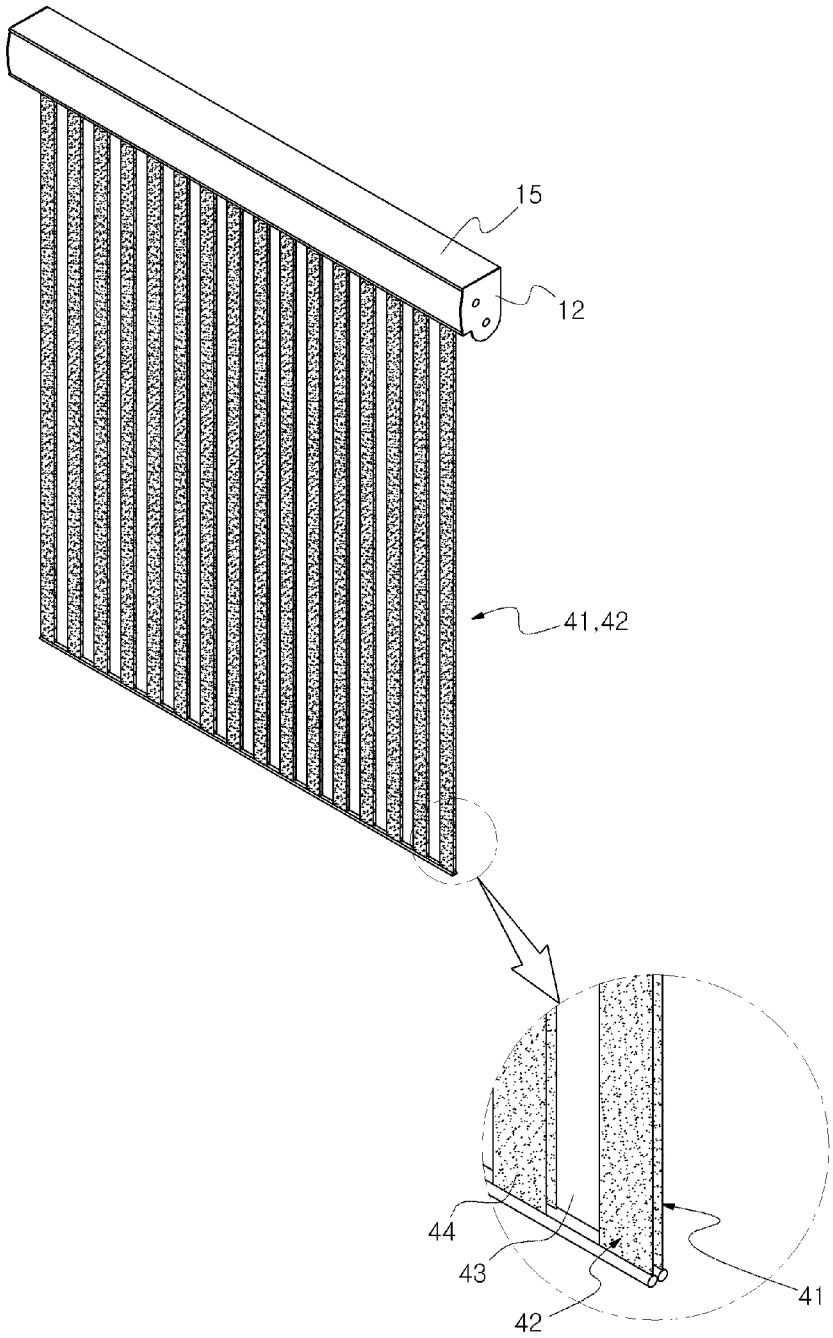
FIG. 1 is a perspective view of a dual roll blind according to an embodiment of the present invention.

1: dual roll blind
11: clutch body
12: end body
13: first rotation shaft
14: second rotation shaft
21: plug
23: first gear
24: second gear
25, 26: end shaft
27: spiral groove
28: concave groove
29: clutch hub
31: first winding bar
32: second winding bar
41: first screen
42: second screen
50: driving wheel
51: driving string
52: coupling groove
53: gear portion
54: long groove
61: slide cylinder
61*a*: thread groove
62: connecting driving shaft
62*a*: driving gear
62*b*: screw portion
71: clutch ring
71*a*: inner protrusion
71*b*: outer protrusion

MODE FOR THE INVENTION

Advantages and features of the present invention and methods to achieve the same will be clear by referring to the attached drawings and the following embodiments described in detail. However, the present invention is not limited to the following described embodiments but can be realized in various forms different from each other. The present embodiments are provided only to make the description of the present invention perfect and to let persons of ordinary skill in the pertinent art perfectly know the scope of the invention and the present invention is defined only by the scope of claims. Like reference numerals denote like parts throughout the specification and drawings.

Hereinafter, a dual roll blind according to an embodiment of the present invention will be described in detail referring to FIGS. 1 to 13.

Figure 2:
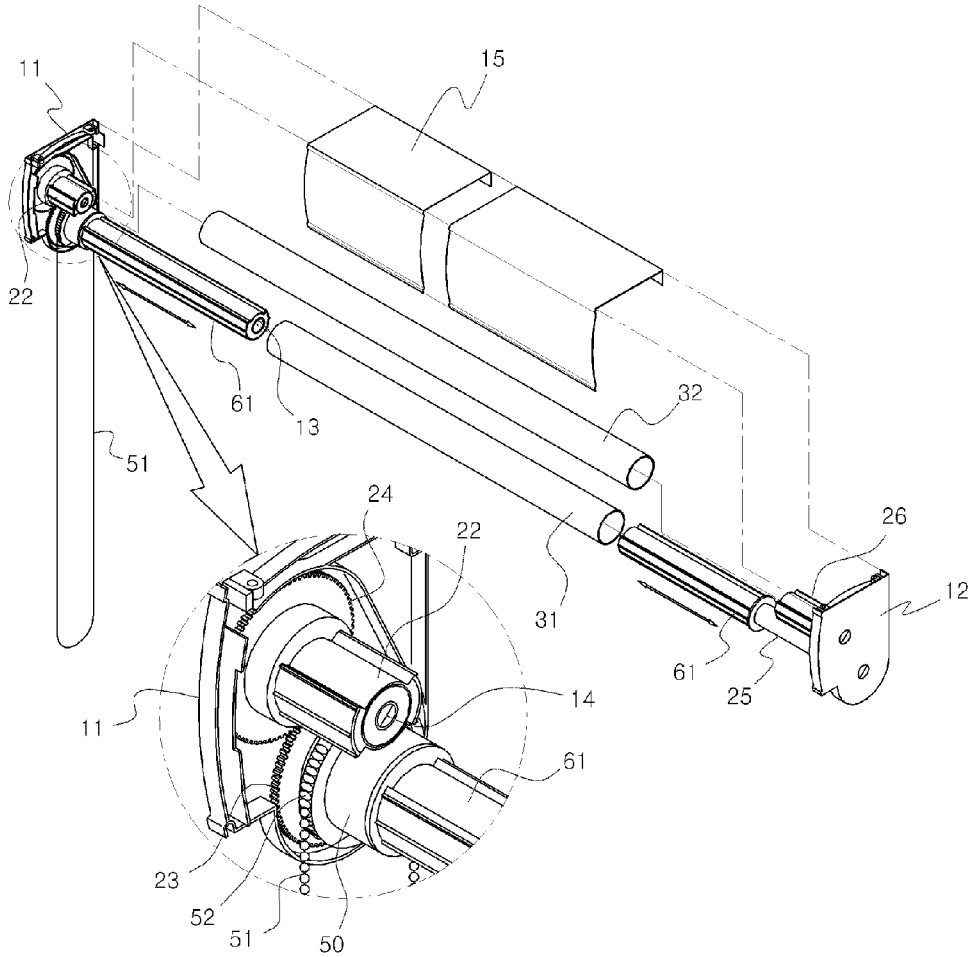
FIG. 2 is an exploded perspective view of the dual roll blind in FIG. 1.

FIG. 1 is a perspective view of a dual roll blind according to an embodiment of the present invention and FIG. 2 is an exploded perspective view of the dual roll blind in FIG. 1.

The dual roll blind 1 according to an embodiment of the present invention is a device capable to control the light transmission amount as well as the open and close of roll screens 41 and 42 only by operating one single driving string 51.

The dual roll blind 1 comprises two roll screens 41 and 42 having light shielding portions 44 and light transmitting portions 43, two winding bars 31 and 32 for respectively winding the two roll screens 41 and 42, and a driving string 51 for rotating the two winding bars 31 and 32.

To describe the above concretely referring to FIGS. 1 and 2, the first winding bar 31 and the second winding bar 32 around which the first screen 41 and the second screen 42 are respectively wound are held inside a structure comprising a support frame 15, a clutch body 11, and an end body 12.

The support frame 15 is a part forming a support structure of the dual roll blind 1 with the clutch body 11 and the end body 12 and holds the first winding bar 31 and the second winding bar 32 inside. The support frame 15 like the above does a function for fixing the dual roll blind 1 to a ceiling or a window frame, etc.

The support frame 15 connects the clutch body 11 and the end body 12 and its length can be changed in response to the lengths of the first winding bar 31 and the second winding bar 32 held inside. The support frame 15 can be formed in the upper portion or in the front and back sides of the first winding bar 31 and the second winding bar 32. For example, as shown in FIG. 2, the support frame 15 can be formed to have a cross-section of the connected upper and front portions in the form of '¬'. That is, the support frame 15 shown in FIG. 2 does a role of a support structure, besides does a role of protecting the first winding bar 31 and the second winding bar 32 held inside and preventing dust from entering inside.

On both ends of the support frame 15, the clutch body 11 and the end body 12 are coupled. In addition, the first winding bar 31 around which the first screen 41 is wound and the second winding bar 32 around which the second screen 42 is wound are rotatably coupled between the clutch body 11 and the end body 12.

On one side of the clutch body 11, a first rotation shaft 13 and a second rotation shaft 14 are formed, and to the first rotation shaft 13 and the second rotation shaft 14, a first gear 23 and a second gear 24 are respectively coupled.

Meanwhile, on the first rotation shaft 13, a clutch device 70 and a slide drive device 60 are mounted. The clutch device 70 and the slide drive device 60 do roles of selectively transferring rotational force to the first winding bar 31 and the second winding bar 32 or controlling the light transmission amount of the dual roll blind 1. The clutch device 70 and the slide drive device 60 will be described in detail later.

The clutch body 11 comprises the first rotation shaft 13 and the second rotation shaft 14 into which the first gear 23 and the second gear 24 are respectively inserted. The first gear 23, which is a driving gear, is inserted into the first rotation shaft 13 and the second gear 24, which is a driven gear, is inserted into the second rotation shaft 14. Accordingly, the first gear 23 and the second gear 24 engage with each other and the second gear 24 rotates depending on the first gear 23.

Meanwhile, the first rotation shaft 13 can be formed longer than the second rotation shaft 14 in order that the slide drive device 60 will be described later can be mounted on. The first rotation shaft 13 and the second rotation shaft 14 are disposed in places spaced as far as the first gear 23 and the second gear 24 can engage with each other considering the sizes of the first gear 23 and the second gear 24.

The first rotation shaft 13 and the second rotation shaft 14 can be diagonally disposed. Since the first rotation shaft 13 and the second rotation shaft 14 are the axes of rotation of the first winding bar 31 and the second winding bar 32, respectively, the placement of the first rotation shaft 13 and the second rotation shaft 14 affects the space between the first screen 41 and the second screen 42 respectively wound around the first winding bar 31 and the second winding bar 32. For example, in case that the first rotation shaft 13 and the second rotation shaft 14 are disposed in a horizontal direction, the initial space between the first screen 41 and the second screen 42 can be larger. However, in case that the first rotation shaft 13 and the second rotation shaft 14 are disposed in a diagonal direction, the space between the first screen 41 and the second screen 42 can be minimized and the size of the clutch body 11 can be decreased to be compact.

Into the first rotation shaft 13, the first gear 23, the clutch hub 29, the clutch ring 71, and the driving wheel 50 are successively inserted. The first gear 23 and the clutch hub 29 always engage with each other and the driving wheel 50 transfers driving force generated by the driving string 51 to the first gear 20 through the clutch hub 29 and the clutch ring 71.

The driving wheel 50 driven by the driving string 51 is coupled to the first gear 23 and the first gear 23 unwinds/winds the first screen 41 around the first winding bar 31 using driving force transferred through the driving wheel 50. At the same time, the second gear 24 unwinds/winds the second screen 42 around the second winding bar 32.

The end body 12 supports the first winding bar 31 and the second winding bar 32 with the clutch body 11 and comprises two end shafts 25 doing a role of axis of rotation of the first winding bar 31 and the second winding bar 32.

The first screen 41 and the second screen 42 are overlapped and form a roll screen 41 and 42. That is, the roll screen 41 and 42 is opened or closed by the simultaneous ascent or descent of the first screen 41 and the second screen 42 and the light shielding amount is controlled by controlling the overlapped range of the light shielding portions 44 respectively included in the first screen 41 and the second screen 42.

The first screen 41 and the second screen 42 as the above are separated from each other.

The first screen 41 and the second screen 42 respectively comprise the light shielding portions 44 and the light transmitting portions 43. Here, the light shielding portions 44 are portions where light is blocked and the light transmitting portions 43 are portions where light passes through. However, the light shielding ratio and the light transmitting ratio of the light shielding portions 44 and the light transmitting portions 43 are not 100%, but these can be used as relative means. For example, the light transmitting ratio of the light shielding portions 44 can be 20% and the light transmitting ratio of the light transmitting portions 43 can be 80%. That is, the light shielding portions 44 mean portions having a relatively low light transmitting ratio. In whole area of the first screen 41 and the second screen 42, portions having a high light transmitting ratio can be called light transmitting portions 43 and portions having a low light transmitting ratio can be called light shielding portions 44.

Meanwhile, the light shielding portions 44 and the light transmitting portions 43 can be formed in the form of stripes. For example, as shown in FIG. 1, stripes perpendicular to the first winding bar 31 and the second winding bar 32 can be formed. The light shielding portions 44 and the light transmitting portions 43 like the above can alternately be disposed.

In addition, the widths of the light shielding portions 44 and the light transmitting portions 43 can be same or the widths of the light shielding portions 44 can be larger than those of the light transmitting portions 43. That is, it is preferable that the widths of the light shielding portions 44 are at least same with or larger than those of the light transmitting portions 43 to make the whole area of the role screen 41 and 42 possible to block light by alternately disposing the light shielding portions 44 of the first screen 41 and the light shielding portions 44 of the second screen 42.

The pattern of the light shielding portions 44 and the light transmitting portions 43 is not limited to a form of horizontally arranged stripes, but the same can be changed into various forms. For example, a pattern of diagonally arranged stripes, a pattern of dots, etc. can be applied.

Meanwhile, since the first gear 23 and the second gear 24 engage with each other, their rotational directions are opposite to each other. Accordingly, in order that the first screen 41 and the second screen 42 simultaneously ascend or descend by the operations of the first gear 23 and the second gear 24, the directions of the first screen 41 and the second screen 42 wound around the first winding bar 31 and the second winding bar 32 are opposite to each other. For example, the first screen 41 can be wound around the first winding bar 31 in order that the first screen 41 ascends when the first winding bar 31 rotates clockwise, and the second screen 42 can be wound around the second winding bar 32 in order that the second screen 42 ascends when the second winding bar 32 rotates counterclockwise. When the first screen 41 and the second screen 42 are wound around the first winding bar 31 and the second winding bar 32 in such a way, the first screen 41 and the second screen 42 can simultaneously ascend or descend with minimizing the space between the first screen 41 and the second screen 42.

Only, the way of winding the first screen 41 and the second screen 42 is not limited to one that the first screen 41 and the second screen 42 are wound in directions opposite to each other. For example, in case that a intermediate gear (not shown) is interposed between the first gear 23 and the second gear 24, the first gear 23 and the second gear 24 can rotate in the same direction. Accordingly, the directions for winding the first screen 41 and the second screen 42 around the first winding bar 31 and the second winding bar 32 are same.

Hereinafter, the slide drive device and the clutch device will be described in detail referring to FIGS. 3 to 6.

Figure 3:
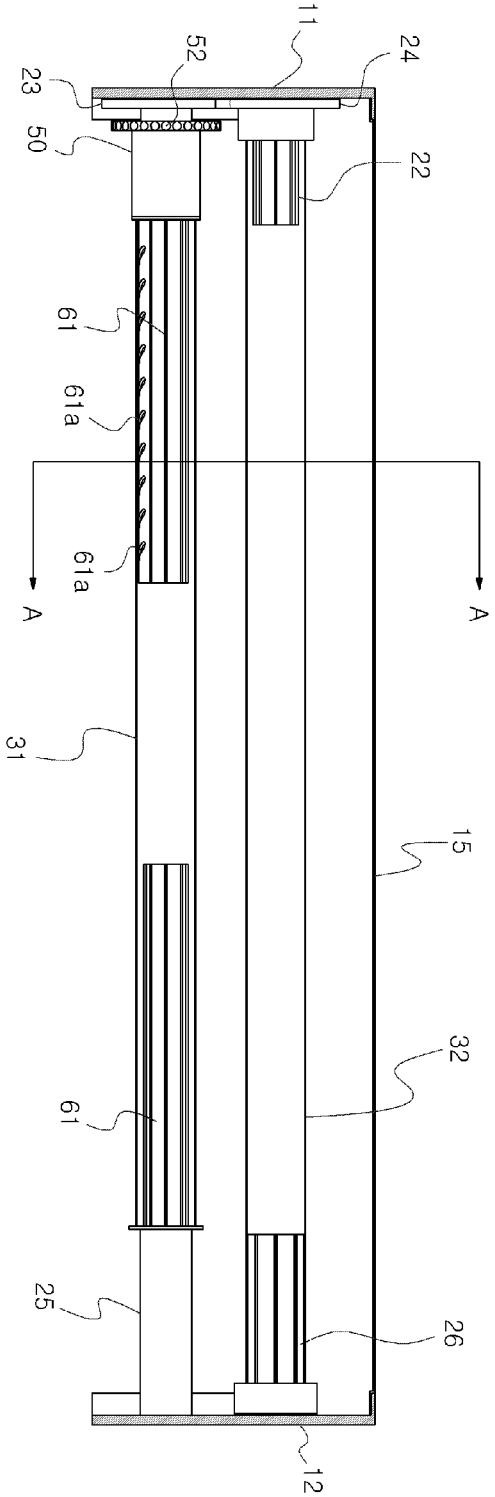
FIG. 3 is a front sectional view of the dual roll blind in FIG. 1.
Figure 4:
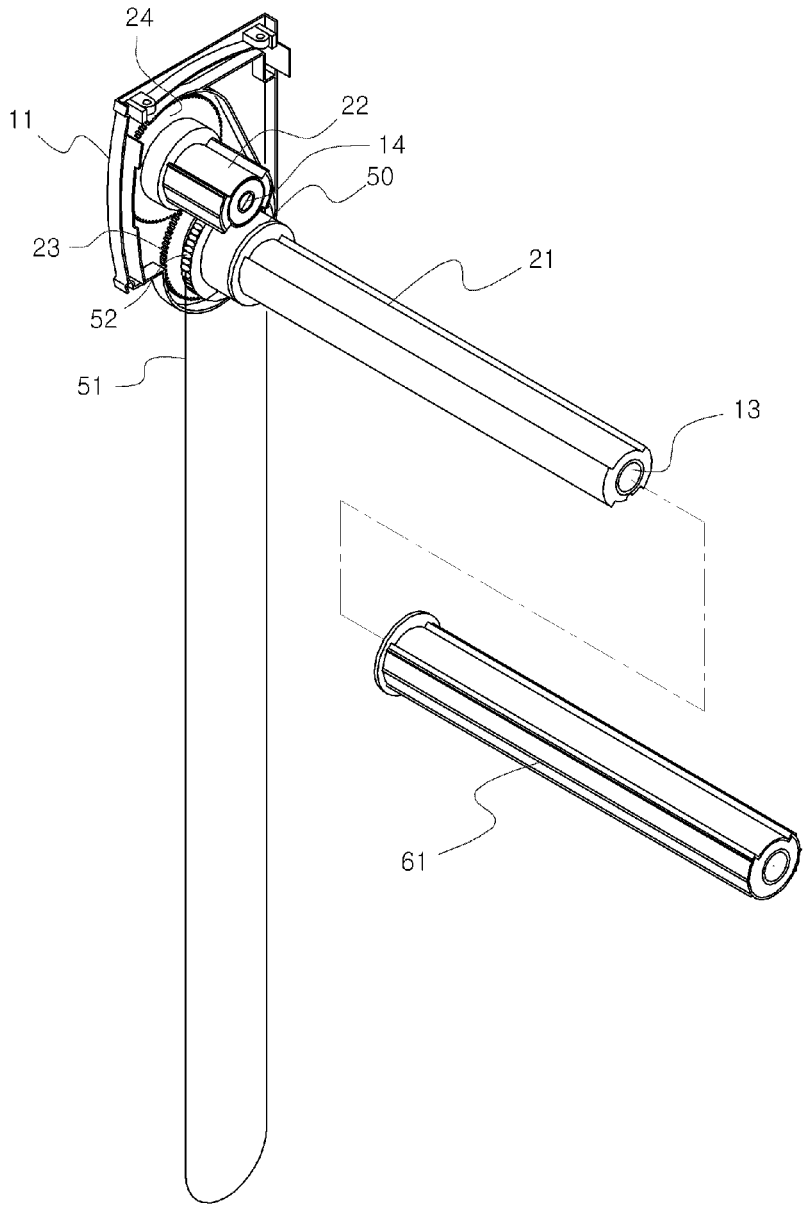
FIG. 4 is an exploded perspective view showing a main part of the dual roll blind of FIG. 1.
Figure 5:
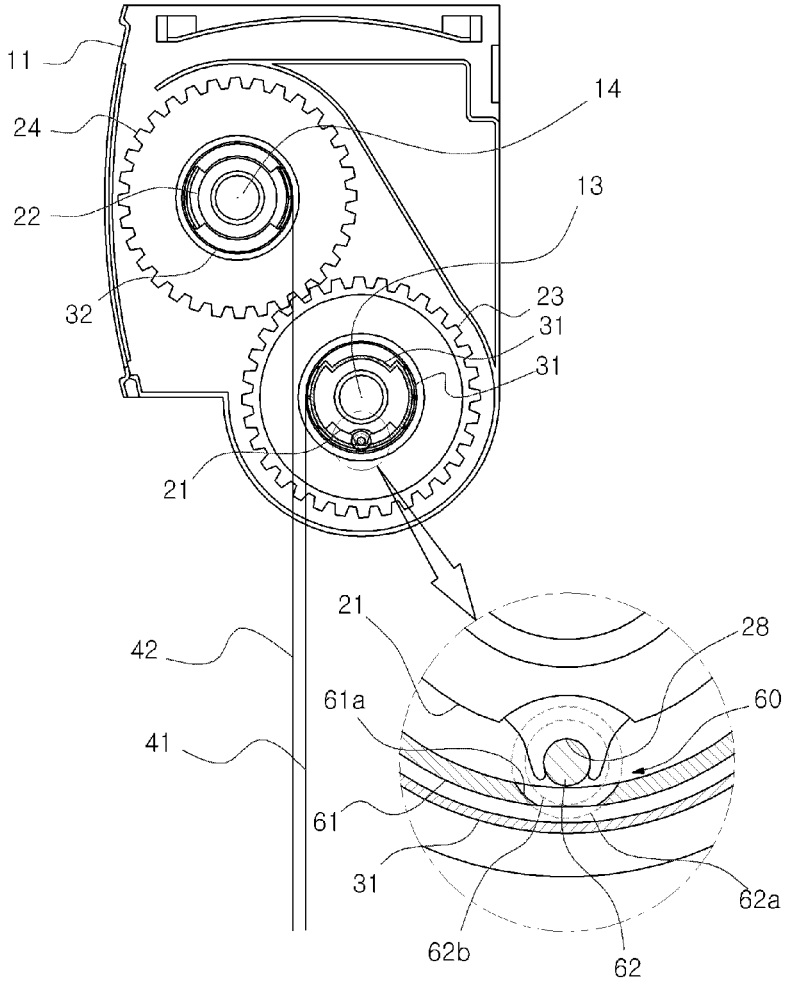
FIG. 5 is a side sectional view obtained by sectioning the dual roll blind in FIG. 3 along the A-A line.
Figure 6:
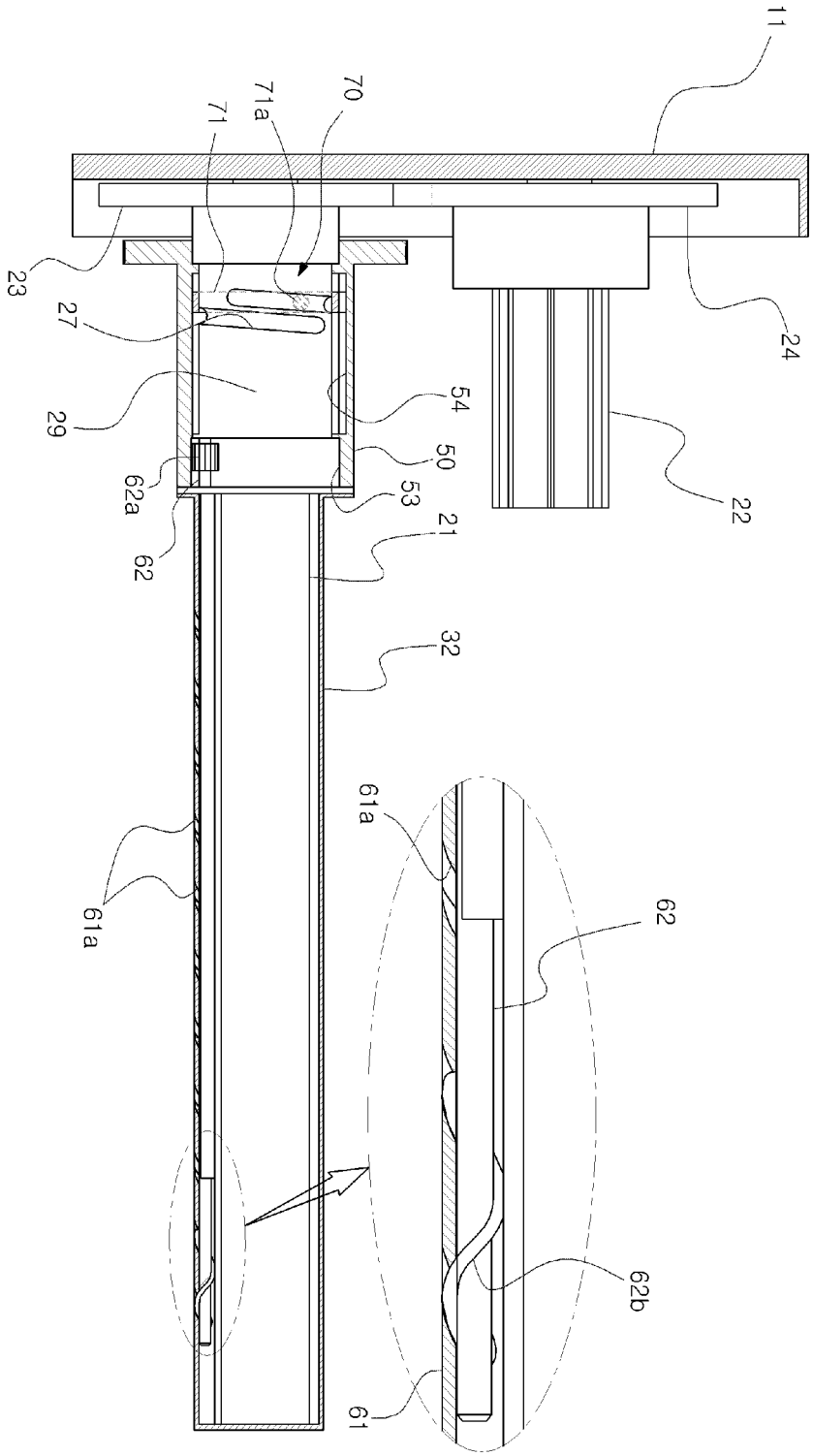
FIG. 6 is a front sectional view showing a main part of the dual roll blind of FIG. 1.
Figure 7:
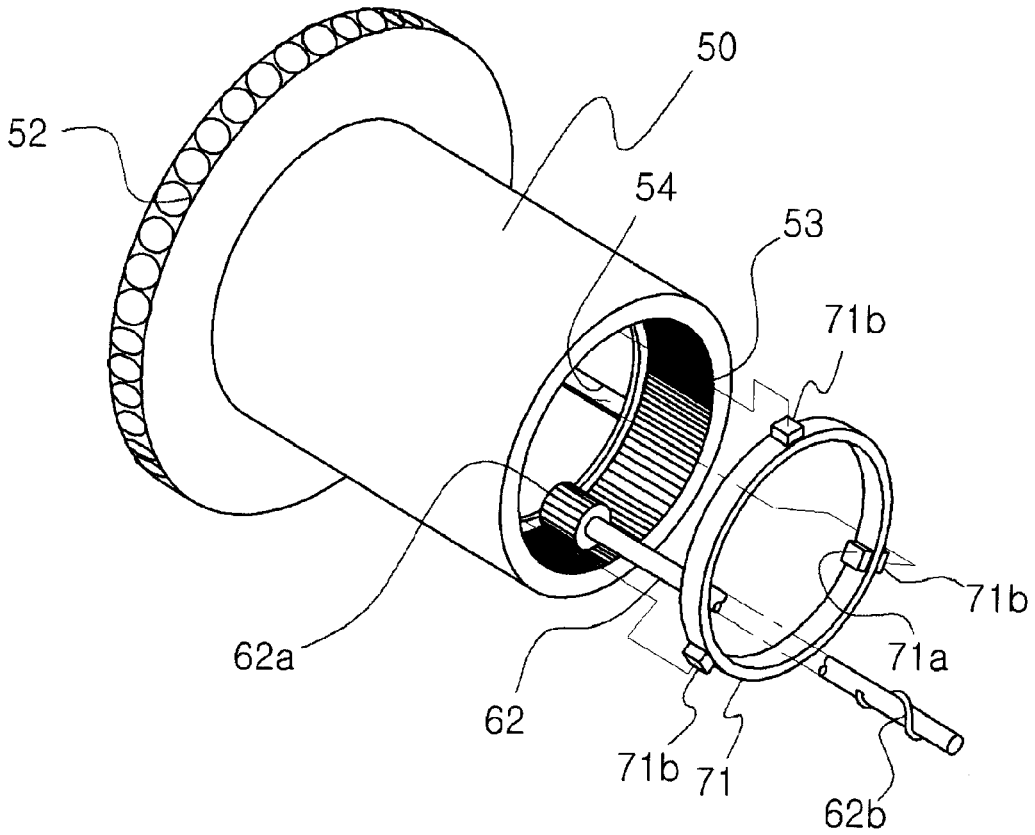
FIG. 7 is an exploded sectional view showing a driving wheel, a clutch ring, and a connecting driving shaft included in the dual roll blind of FIG. 1.
Figure 8:
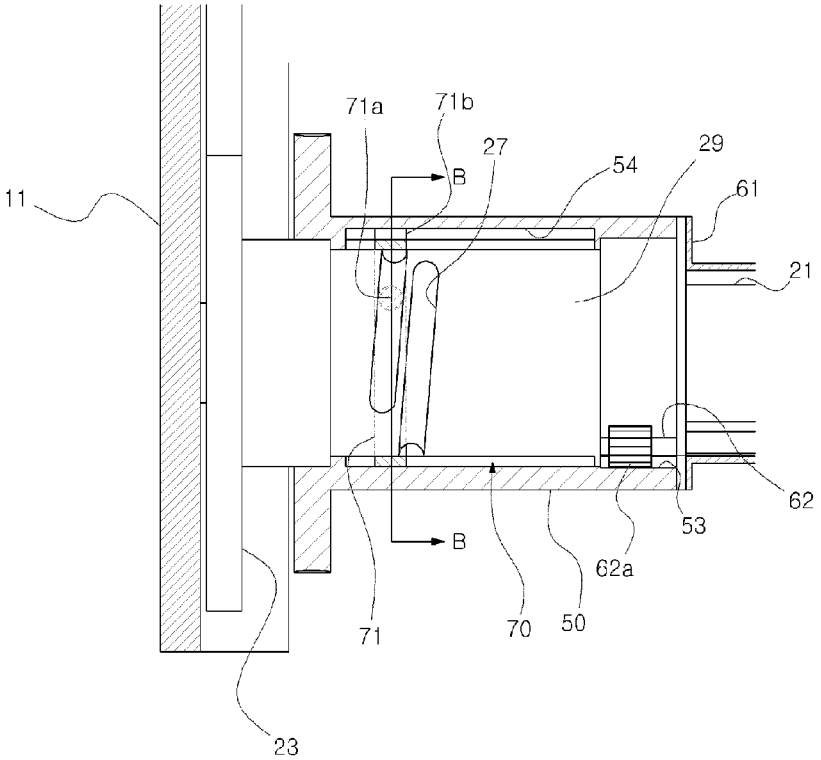
FIG. 8 is a front sectional view showing a clutch device of the dual roll blind in FIG. 1.
Figure 9:
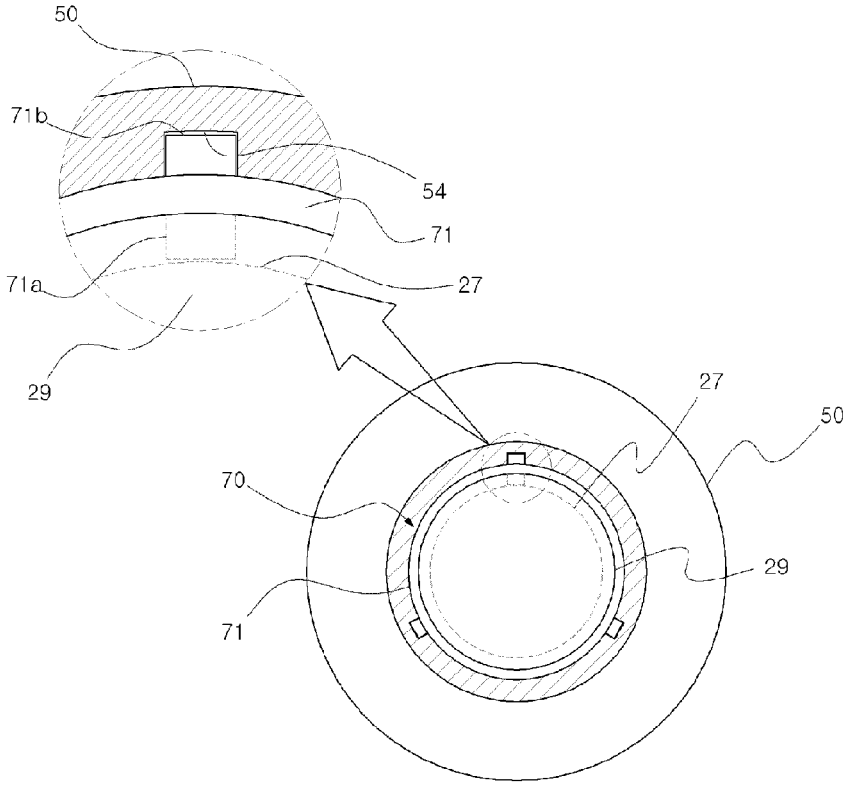
FIG. 9 is a sectional view obtained by sectioning the clutch device in FIG. 8 along the B-B line.

FIG. 3 is a front sectional view of the dual roll blind in FIG. 1, FIG. 4 is an exploded perspective view showing a main part of the dual roll blind of FIG. 1, FIG. 5 is a side sectional view obtained by sectioning the dual roll blind in FIG. 3 along the A-A line, FIG. 6 is a front sectional view showing a main part of the dual roll blind of FIG. 1, FIG. 7 is an exploded sectional view showing a driving wheel, a clutch ring, and a connecting driving shaft included in the dual roll blind of FIG. 1, FIG. 8 is a front sectional view showing a clutch device of the dual roll blind in FIG. 1, and FIG. 9 is a sectional view obtained by sectioning the clutch device in FIG. 8 along the B-B line.

The slide drive device 60 is mounted in parallel with the axial direction (longitudinal direction) of the first rotation shaft 13 on one side of the first rotation shaft 13 and comprises a connecting driving shaft 62 on both ends of which a driving gear 62*a* and a screw portions are respectively formed. Accordingly, when the driving wheel 50 rotates, the connecting driving shaft 62 rotates and it makes a slide cylinder 61 can slide in parallel with the axial direction of the first rotation shaft 13.

The slide cylinder 61 is interposed between the first rotation shaft 13 and the first winding bar 31 and fixed to the first winding bar 31 to integrally do sliding movement with the first winding bar 31. To describe the above concretely, the slide cylinders 61, as shown in FIG. 3, are respectively coupled to the first rotation shaft 13 and the end shaft 25 and inserted into and fixed to both ends of the first winding bar 31. Accordingly, the slide cylinders 61 can move in parallel to an axial direction of the first rotation shaft 13 with the first winding bar 31.

As shown in FIG. 3, a thread groove 61*a* is formed in the parallel direction with the first axis of rotation of the first rotation shaft 13 on a side of the slide cylinder 61. The thread groove 61*a* can be formed on a surface of the inner circumference of the slide cylinder 61 or with passing through the side wall of the cylinder.

The thread groove 61*a*, for example, can be multiple grooves forming a certain angle to the first axis of rotation of the first rotation shaft 13 inside the slide cylinder 61. Accordingly, one end portion of the screw portion 62*b* of the connecting driving shaft 62 is inserted into the thread groove 61*a* and the screw portion 62*b* can rotate along the thread groove 61*a*.

Meanwhile, as shown in FIG. 6, the screw portion 62*b* can be formed in the form of coil surrounding the connecting driving shaft 62. That is, the screw portion 62*b* is formed in a form that a wire surrounds the connecting driving shaft 62 and the wire functions as gear teeth. Accordingly, the screw portion 62*b* and the thread groove 61*a* can move the slide cylinder 61 from side to side by a screw operation. Here, the screw portion 62*b* and the thread groove 61*a* can be a type of right screw.

The slide cylinder 61 does rectilineal movement by the rotation of the connecting driving shaft 62. The connecting driving shaft 62 comprises the driving gear 62*a* engaging with the driving wheel 50 on one end portion and the screw portion 62*b* coupled with the thread groove 61*a* on the other end portion. Accordingly, the driving gear 62*a* and the screw portion 62*b* integrally rotates in the same direction.

Referring to FIG. 6, the driving wheel 50 is rotatably coupled to the first rotation shaft 13 and comprises a gear portion 53 with which the driving gear 62*a* engages on the inner circumference. That is, the gear portion 53 is a kind of internal gear and the same can be a form that the driving gear 62*a* is inserted inside the driving wheel 50 and rotates. The connecting driving shaft 62 as the above is formed in parallel with the first rotation shaft 13 and the directions of axes of rotation of the driving wheel 50 and the driving gear 62*a* are same.

Meanwhile, the gear portion 53 of the driving wheel 50 is not limited to the internal gear. For example, the gear portion can be formed in the form of spur gear on the outer circumference of the driving wheel 50 and the driving gear 62*a* can be formed in the form of planetary gear in contact with the gear portion from outside.

The connecting driving shaft 62 is rotatably inserted into a concave groove 28 formed in a plug 21 coupled to the first rotation shaft 13. The concave groove 28 is formed long in an axial direction of the first rotation shaft 13 on the outer circumference of the plug 21.

The clutch device 70 selectively transfers rotational driving force of the driving wheel 50 to the second winding bar 32. Concretely, the clutch device 70 temporarily does not transfer rotational driving force to the first gear 23 in response to the rotational direction of the driving wheel 50 and controls the slide cylinder 61 to horizontally move during that period of time.

The clutch device 70 comprises a clutch hub 29 coupled to the first rotation shaft 13 and a clutch ring 71 interposed between the clutch hub 29 and the driving wheel 50 as main components. To describe the above concretely, the clutch hub 29 is interposed between the first rotation shaft 13 and the driving wheel 50 and coupled to the first gear 23. In addition, the clutch hub 29 is connected to the plug 21 and the first gear 23, the clutch hub 29, and the plug 21 rotate integrally.

A spiral groove 27 is formed on the outer circumference of the clutch hub 29. The spiral groove 27, for example, can be formed in the direction of left screw and the same is a path which an inner protrusion 71*a* of the clutch ring 71 is inserted into and moves along.

The clutch ring 71 comprises at least one inner protrusion 71*a* inside and at least one outer protrusion 71*b* outside. The clutch ring 71 is formed in the form of ring whose inside is empty and the clutch hub 29 is inserted inside. The inner protrusion 71*a* of the clutch ring 71 is inserted in the spiral groove 27 of the clutch hub 29 and the clutch ring 71 rotates along the outer circumference of the clutch hub 29. The spiral groove 27 like the above makes a kind of delay section where force is not transferred between the clutch hub 29 and the driving wheel 50.

Here, the maximum rotational angle of the clutch ring 71 is decided depending on the length of the spiral groove 27. That is, the clutch ring 71 does not rotate with the clutch hub 29 in a section where the inner protrusion 71*a* moves along the spiral groove 27, but when the inner protrusion 71*a* reaches the end of the spiral groove 27, the clutch hub 29 and the clutch ring 71 rotate together. A section where the clutch ring 71 does not rotate with the clutch hub 29 is the section where the slide cylinder 61 moves horizontally. Accordingly, as the length of the spiral groove 27 is longer, the length of the section where the slide cylinder 61 moves horizontally is longer. That is, in case that the space between the light shielding portions 44 and the light transmitting portions 43 of the roll screen 41 and 42 is wide, the spiral groove 27 can be formed long.

Meanwhile, the driving wheel 50 comprises inside a long groove 54 where the outer protrusion 71*b* of the clutch ring 71 moves. The long groove 54 is formed long in a parallel direction with the first axis of rotation of the first rotation shaft 13 on the inner surface of the driving wheel 50. The long groove 54 like this can be formed as many as the number of the outer protrusion 71*b* and the length of the long groove 54 can mean the distance that the clutch ring 71 can move.

Hereinafter, the operation process of the clutch device and the slide drive device of the dual roll blind referring to FIGS. 10 and 11.

Figure 10:
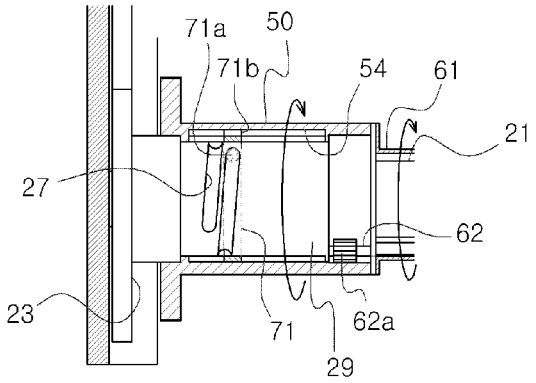
FIG. 10 is a drawing of operation for describing operation process of the clutch device included in the dual roll blind of FIG. 1.
Figure 10:
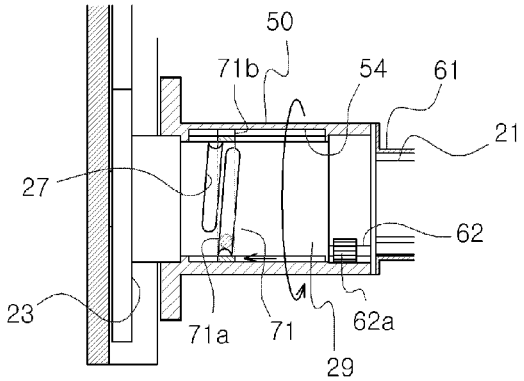
Figure 10:
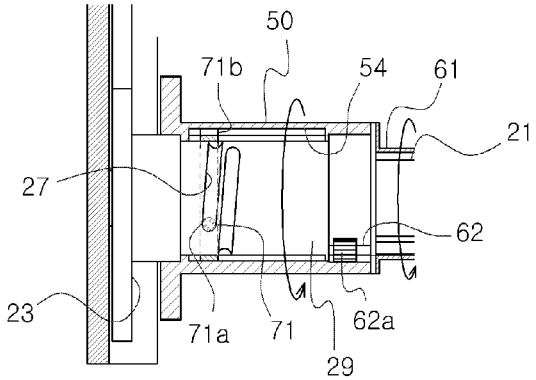
Figure 11:
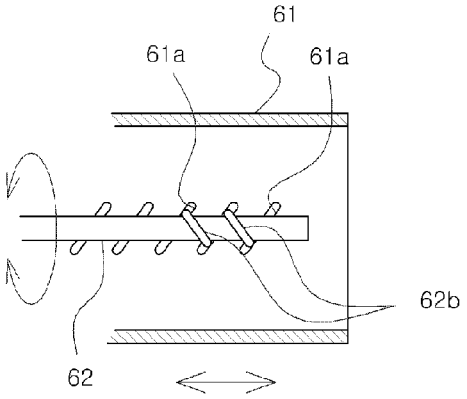
FIG. 11 is a drawing of operation for describing operation of the slide drive device included in the dual roll blind of FIG. 1.

FIG. 10 is a drawing of operation for describing operation process of the clutch device included in the dual roll blind of FIG. 1 and FIG. 11 is a drawing of operation for describing operation of the slide drive device included in the dual roll blind of FIG. 1.

First, referring to (a) of FIG. 10, the driving wheel rotates clockwise by operating the driving string 51. At this moment, the driving wheel 50 rotates the clutch ring 71 inserted inside the driving wheel 50. The clutch ring 71 rotates along with the driving wheel 50 since the outer protrusion 71*b* of the clutch ring 71 is inserted into the long groove 54 of the driving wheel 50.

Meanwhile, the inner protrusion 71*a* of the clutch ring 71 reaches the end portion of the spiral groove 27 and the rotational force of the clutch ring 71 is transferred to the clutch hub 29. Accordingly, the clutch hub 29 rotates clockwise along with the driving wheel 50 and the first gear 23 and the plug 21 coupled with the clutch hub 29 rotate together.

Next, referring to (b) of FIG. 10, the driving wheel 50 rotates counterclockwise by operating the driving string 51. At this moment, the driving wheel 50 rotates along with itself the clutch ring 71 inserted inside the driving wheel 50. The clutch ring 71 rotates along with the driving wheel 50, however, the clutch hub 29 does not rotate along with the clutch ring 71 because the inner protrusion 71*a* of the clutch ring 71 moves along the spiral groove 27. That is, the clutch ring 71 rotates along the outer circumference of the clutch hub 29 and the outer protrusion 71*b* of the clutch ring moves along the long groove 54 of the driving wheel 50.

Accordingly, the clutch ring 71 moves horizontally in the same direction as the first axis of rotation of the first rotation shaft 13 along the first rotation shaft 13.

At this time, the driving wheel 50 rotates counterclockwise, the clutch hub 29 does not rotate and the first gear 23 and the plug 21 coupled with the clutch hub 29 do not rotate.

Next, referring to (c) of FIG. 10, when the driving wheel 50 continuously rotates counterclockwise, the inner protrusion 71*a* of the clutch ring 71 reaches the other end of the spiral groove 27. In this case, the horizontal movement of the clutch ring 71 is stopped and the rotational force of the clutch ring 71 is transferred to the clutch hub 29. Accordingly, the clutch hub 29 rotates counterclockwise, in the same direction as the driving wheel 50, and the first gear 23 and the plug 21 coupled with the clutch hub 29 rotate counterclockwise too.

In conclusion, the cases of (a) and (c) of FIG. 10 that the plug 21 rotates show a section where the first screen 41 ascends or descends and the case of (b) of FIG. 10 that the plug 21 does not rotate shows a section where the first screen 41 moves horizontally in an axial direction of the first rotation shaft 13.

In the (b) section of FIG. 10, the plug 21 does not rotate while the driving wheel 50 rotates counterclockwise and the driving gear 62*a* in contact with the gear portion 53 of the driving wheel 50 rotates.

When the driving gear 62*a* rotates, as shown in FIG. 11, the connecting driving shaft 62 rotates, and when the connecting driving shaft 62 rotates, the slide cylinder 61 moves horizontally by the screw operation of the screw portion 62*b* and the thread groove 61*a*.

Figure 12:
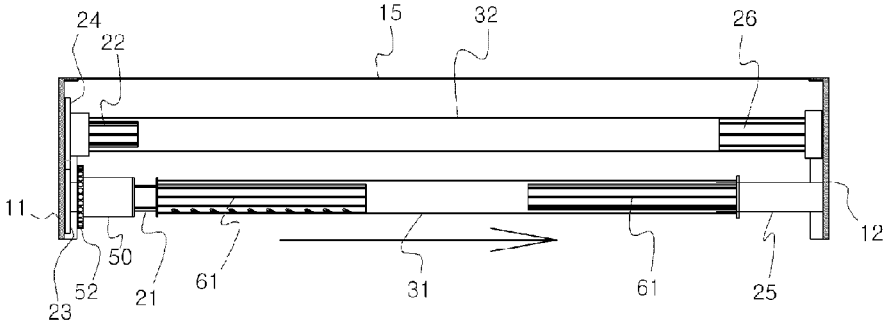
FIGS. 12 and 13 are drawings for describing operation process of the dual roll blind of FIG. 1.
Figure 13:
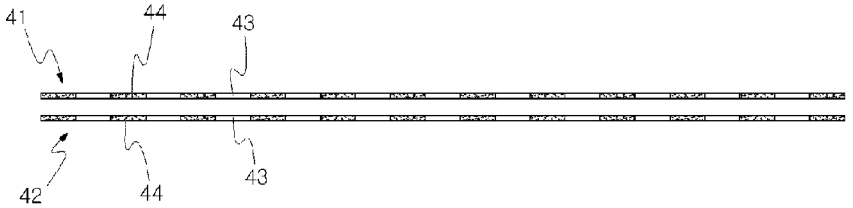
Figure 13:
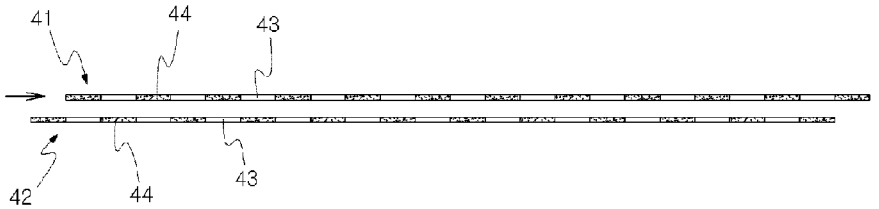

FIGS. 12 and 13 are drawings for describing operation process of the dual roll blind of FIG. 1.

Referring to FIG. 12, the slide cylinders 61 are respectively inserted into the both ends of the first winding bar 31. The slide cylinders 61 are respectively inserted into the first rotation shaft 13 and the end shaft 25. The winding bar 31 like this can horizontally move in the axial direction of the first rotation shaft 13. When the first winding bar 31 moves horizontally like this, the first screen 41 moves horizontally.

As shown in FIG. 13 (*a*), when the light transmitting portions 43 of the first screen 41 and the light transmitting portions 43 of the second screen 42 are overlapped at first, light passes through the roll screen 41 and 42. However, when the first winding bar 31 moves horizontally and the light transmitting portions 43 of the first screen and the light shielding portions 44 of the second screen 42 are overlapped, light cannot pass through the roll screen 41 and 42.

INDUSTRIAL APPLICABILITY

Although the embodiments of the present invention are described referring to attached drawings in the above, persons of ordinary skill in the art where the present invention belongs will be able to understand that the present invention can be realized in other concrete forms without changing the technical ideas or essential features. Therefore, all the above-described embodiments should be understood as examples and not limitative in every aspect.

The invention claimed is:

1. A dual roll blind comprising:

a first screen and a second screen, each screen having light transmission portions and light shielding portions, respectively;

a first winding bar and a second winding bar for respectively winding the first screen and the second screen;

a first rotation shaft and a second rotation shaft to which the first winding bar and the second winding bar are respectively coupled;

a first gear coupled to the first rotation shaft and rotationally driving the first winding bar;

a second gear coupled to the second rotation shaft and rotating the second winding bar, wherein the second gear engages with the first gear;

a driving wheel rotated by a driving string and coupled to the first rotation shaft to transfer rotational force of the driving string to the first gear and the first winding bar; and a slide drive device engaging with the driving wheel to receive rotational force of the driving wheel and slide the first winding bar in a longitudinal direction of the first rotation shaft, wherein the slide drive device comprises a slide cylinder interposed between the first rotation shaft and the first winding bar and having a thread groove disposed on an outside surface of the slide cylinder in a parallel direction with the longitudinal direction of the first rotation shaft.

2. The dual roll blind according to the claim 1, wherein the slide drive device comprises a connecting driving shaft disposed in parallel with the first axis of rotation of the first rotation shaft, to one end of which a driving gear engaging with the driving wheel is coupled and on the other end of which a screw portion coupled with the thread groove is formed.

3. The dual roll blind according to the claim 2, further comprising a plug interposed between the first rotation shaft and the slide cylinder and having a concave groove extended in a longitudinal direction from the outer circumference, wherein the connecting driving shaft is configured to be rotatably inserted into the concave groove.

4. The dual roll blind according to the claim 2, wherein the driving wheel comprises an internal gear portion disposed on an inner circumferential surface thereof, and the driving gear is positioned inside the driving wheel and engages with the gear portion.

5. The dual roll blind according to the claim 1, further comprising a clutch device interposed between the first rotation shaft and the driving wheel to selectively transfer rotational driving force of the driving wheel to the first winding bar.

6. The dual roll blind according to the claim 5, wherein the clutch device comprises:

a clutch hub interposed between the first rotation shaft and the driving wheel, and having a spiral groove disposed on an outer circumferential surface of the clutch hub;

a clutch ring interposed between the clutch hub and the driving wheel, and having an inner protrusion configured to be inserted into the spiral groove inside; and at least one outer protrusion, and wherein the driving wheel comprises on an inner circumferential surface thereof at least one elongated groove formed in parallel with the first axis of rotation of the first rotation shaft, and into which the at least one outer protrusion is inserted.

* * * * *